US010640948B2

(12) United States Patent
Ishiai et al.

(10) Patent No.: US 10,640,948 B2
(45) Date of Patent: May 5, 2020

(54) WORKING DEVICE

(71) Applicant: Takeuchi Mfg. Co., Ltd., Nagano (JP)

(72) Inventors: Akihiro Ishiai, Ueda (JP); Takenori Nishizawa, Ueda (JP)

(73) Assignee: Takeuchi Mfg. Co., Ltd., Nagano (JP)

( * ) Notice: Subject to any disclaimer, the term of this patent is extended or adjusted under 35 U.S.C. 154(b) by 0 days.

(21) Appl. No.: 16/257,877

(22) Filed: Jan. 25, 2019

(65) Prior Publication Data

US 2020/0080276 A1 Mar. 12, 2020

(30) Foreign Application Priority Data

Sep. 6, 2018 (JP) ..... 2018-166839

(51) Int. Cl.

| | |
|---|---|
| ***E02F 3/36*** | (2006.01) |
| ***E02F 9/00*** | (2006.01) |
| *E02F 3/65* | (2006.01) |
| *E02F 9/22* | (2006.01) |
| *E02F 3/30* | (2006.01) |
| *E02F 3/34* | (2006.01) |
| *E02F 3/38* | (2006.01) |
| *E02F 3/84* | (2006.01) |

(52) U.S. Cl.

CPC ..... *E02F 3/3663* (2013.01); *E02F 9/006* (2013.01); *E02F 3/303* (2013.01); *E02F 3/34* (2013.01); *E02F 3/382* (2013.01); *E02F 3/651* (2013.01); *E02F 3/84* (2013.01); *E02F 9/2275* (2013.01)

(58) Field of Classification Search

CPC ..... E02F 9/006; E02F 3/3609
USPC ..... 414/723; 37/188
See application file for complete search history.

(56) References Cited

U.S. PATENT DOCUMENTS 3,966,070 A * 6/1976 Barth ..... B66F 9/10 414/713
6,332,747 B1 * 12/2001 Lee ..... E02F 3/3636 37/468
2013/0051964 A1 * 2/2013 Bernier ..... E02F 3/32 414/722

FOREIGN PATENT DOCUMENTS

GB 2072136 A 9/1981
JP 2007-314981 A 12/2007

OTHER PUBLICATIONS

Extended European Search Report issued by the European Patent Office dated Sep. 11, 2019, which corresponds to EP19154096.2-1018 and is related to U.S. Appl. No. 16/257,877.

* cited by examiner

*Primary Examiner* — Ronald P Jarrett
(74) *Attorney, Agent, or Firm* — Studebaker & Brackett PC

(57) ABSTRACT

A working device is provided wherein a tilt bucket 70 is pivotally joined, vertically swingably, to the tip of an arm 33 by a third pivot joint pin P3 and is vertically swung by a bucket cylinder 38 via first link members 81A, 81B and a second link member 82. The connection unit 100 to be connected to the first link members 81A, 81B is pivotally joined, vertically swingably, to the tip of the bucket cylinder 38. By switching the connection position of connection pins 131A, 131B of the connection unit 100 and the first link members 81A, 81B selectively between the position of a connection hole H1 and the position of a connection hole H2, the swing range and excavating force of the tilt bucket 70 are switched.

7 Claims, 17 Drawing Sheets

WORKING DEVICE

TECHNICAL FIELD

The present invention relates to a working device having an arm to which a work attachment can be attached.

TECHNICAL BACKGROUND

Conventionally, working vehicles such as a shovel loader and a hydraulic shovel (also called an excavator, a backhoe, etc.) have been widely known which are used to excavate ground and to move excavated earth and sand and the like. These working vehicles comprise a working device having an arm vertically swingably provided on the vehicle body configured to be movable and are configured such that various work attachments such as a bucket, a chip breaker (also simply called a breaker), and an auger device can be detachably attached to the tip of the arm. And they can efficiently perform predetermined works by replacing the attachment with another by means of detaching and attaching according to the purpose of work.

Among these working devices, there is known a device in which an attachment (e.g., a bucket) vertically swingably attached to the tip of an arm is vertically swung by a hydraulic actuator via a link mechanism (see, e.g., Japanese Laid-Open Patent Publication No. 2007-314981). As the link mechanism, there is known a mechanism configured to have a first link member pivotally joined, vertically swingably, at one end to an arm and a second link member pivotally joined, vertically swingably, at one end to an attachment and at the other end to the other end of the first link member. Further, as the hydraulic actuator, there is known an actuator configured to be pivotally joined, vertically swingably, at its base end to an arm and to be pivotally joined at its tip to the link mechanism to pivot on the pivot joint axis of the two link members.

Problems to be Solved by the Invention

With the working device, it is occasionally desired to switch the operation performance of the attachment operating by the hydraulic actuator, for example, the swing range, excavating force, and the like of the bucket, in the case where the attachment is a bucket, according to the work status, work content, or the like. Conventionally, working vehicles have been known in which a plurality of positions, at which the second link member can be connected, are provided in the bucket so that the operation performance of the bucket is switched by selectively switching between these positions to connect the bucket and the second link member. However, with these working vehicles, because the work of pulling out and inserting a pivotally-joining pin member and so on, which work is necessary to switch the connection position of the bucket and the second link member, is performed manually by a worker, there is the problem that the work takes a lot of labor.

SUMMARY OF THE INVENTION

In view of this problem, the present invention was made, and an object thereof is to provide a working device in which the operation performance of an attachment vertically swingably attached via link members to an arm can be easily switched.

In order to achieve the above object, a working device according to the present invention comprises an arm to which an attachment for work (e.g., a tilt bucket 70 in the embodiment) can be vertically swingably attached; a first link member pivotally joined, vertically swingably, at one end to the arm; a second link member pivotally joined, vertically swingably, at one end to the attachment and at the other end to the other end side of the first link member while the attachment is vertically swingably attached to the arm; and an attachment hydraulic actuator (e.g., a bucket cylinder 38 in the embodiment) pivotally joined, vertically swingably, at its base end to the arm and to vertically swing the attachment with respect to the arm. The working device comprises a connection unit connectable to the first link member and operated by the attachment hydraulic actuator, is configured such that the first link member can be vertically swung by the attachment hydraulic actuator via the connection unit connected to the first link member, is configured such that the first link member and the connection unit can be connected switching selectively between a plurality of positions, and comprises a connection switching means (e.g., a connection pin operation control unit 200 in the embodiment) operated to work so as to switch the connection position of the first link member and the connection unit.

In the above working device, the connection unit is preferably configured to comprise a housing having openings open to right and left directions (e.g., for-connection-pins openings 111*a* in the embodiment); connection pins provided in the housing to operate to be able to protrude and retract through the openings in right and left directions; and a connection pin operating actuator (e.g., a for-connection-pins hydraulic cylinder 132 in the embodiment) provided in the housing to operate the connection pins.

In the above working device, the first link member preferably has a plurality of connection holes which the connection pin can be inserted into and pulled out of (e.g., connection holes H1, H2 in the embodiment).

In the above working device, the connection unit is pivotally joined to the first link member to be swingable around a pivot joint axis line extending in a left-to-right direction; the plurality of connection holes are arranged on the same circumference with the pivot joint axis line as the center; and the working device is preferably configured such that, when the connection unit is swung around the pivot joint axis line while the connection pin has been pulled out of one of the connection holes, the connection pin becomes opposite another of the connection holes to be able to be inserted into.

In the above working device, on the connection unit and the first link member, there are preferably provided stoppers for alignment which abut on each other when, while the connection pin has been pulled out of one of the connection holes, the connection unit is swung around the pivot joint axis line so that the connection pin becomes opposite another of the connection holes to be able to be inserted into, thus restricting swings of the connection unit with respect to the first link member.

In the above working device, the connection unit is preferably pivotally joined to the first link member on a pivot joint axis line of the first link member and the second link member.

In the above working device, the connection pin is swingably attached to a rod tip of the connection pin operating actuator, and the working device is preferably configured such that a radial load acting on the connection pin protruding out of the opening does not act on the connection pin operating hydraulic actuator via the connection pin.

The above working device preferably comprises, in the housing, biasing members (e.g., coil springs 133A, 133B in the embodiment) to bias the connection pins in directions in which to protrude out of the openings.

In the above working device, the connection pin operating actuator is preferably configured to be driven by pilot oil supplied from a pilot pump.

In the above working device, the attachment is preferably a bucket.

The above working device is preferably incorporated in a working vehicle comprising a movable traveling unit and a turning body horizontally pivotally provided on the top of the traveling unit.

Advantageous Effects of the Invention

In the working device configured as above according to the present invention, by switching selectively between a plurality of positions to connect the first link member and the connection unit, the work performance of the attachment vertically swingably attached to the arm via the first link member and the second link member can be switched. Switching the connection position of the first link member and the connection unit can be performed by making the connection unit operate via the attachment hydraulic actuator and operating the connection switching means to work. Thus, in the working device according to the present invention, the work performance of the attachment can be easily switched.

In the above working device according to the present invention, the connection unit is configured to comprise a housing having openings; connection pins to operate to be able to protrude and retract through the openings in right and left directions; and a connection pin operating actuator to operate the connection pins, so that the connection unit can be formed with a simple configuration.

In the above working device according to the present invention, the first link member is configured to have a plurality of connection holes which the connection pin can be inserted into and pulled out of, so that the first link member can be formed with a simple configuration.

In the above working device according to the present invention, the connection unit is pivotally joined to the first link member to be swingable around a pivot joint axis line extending in a left-to-right direction; the plurality of connection holes are arranged on the same circumference with the pivot joint axis line as the center; and the working device is configured such that, when the connection unit is swung around the pivot joint axis line while the connection pin has been pulled out of one of the connection holes, the connection pin becomes opposite another of the connection holes to be able to be inserted into, and thus aligning the connection pin with one of the connection holes, which is necessary when the connection position is switched, can be easily performed.

In the above working device according to the present invention, on the connection unit and the first link member, there are provided stoppers for alignment which abut on each other when, while the connection pin has been pulled out of one of the connection holes, the connection unit is swung around the pivot joint axis line so that the connection pin becomes opposite another of the connection holes to be able to be inserted into, thus restricting swings of the connection unit with respect to the first link member, and thus aligning the connection pin with one of the connection holes can be further easily performed.

In the above working device according to the present invention, the connection pin is swingably attached to a rod tip of the connection pin operating actuator, and the working device is configured such that a radial load acting on the connection pin protruding out of the opening does not act on the connection pin operating hydraulic actuator via the connection pin, so that a fault, which would occur if the radial load acted on the connection pin operating hydraulic actuator, can be prevented from occurring in the connection pin operating hydraulic actuator.

The above working device according to the present invention is configured to comprise, in the housing, biasing members to bias the connection pins in directions in which to protrude out of the openings, so that, even if a fault occurs in the connection pin operating actuator or the like, the connection pins protruding out of the openings can be prevented from unintentionally retracting.

In the above working device according to the present invention, the connection pin operating actuator is configured to be driven by pilot oil supplied from a pilot pump, so that the connection pin operating actuator can be driven without adversely affecting the operation of a hydraulic actuator driven by pressured oil supplied from a hydraulic pump other than the pilot pump.

In the above working device according to the present invention, the attachment is a bucket, so that by switching the connected state of the connection unit and the first link member, the swing range and excavating force of the bucket can be switched.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTIONS OF THE DRAWINGS

The present invention will become more fully understood from the detailed description given herein below and the accompanying drawings which are given by way of illustration only and thus are not limitative of the present invention.

DESCRIPTION OF THE EMBODIMENTS

An embodiment of the present invention will be described below with reference to the drawings. The present embodiment describes a shovel device incorporated in a crawler type of hydraulic shovel (excavator) as an example working device according to the present invention. First, the entire configuration of the hydraulic shovel 1 will be described with reference to FIGS. 1 to 4.

Figure 1:
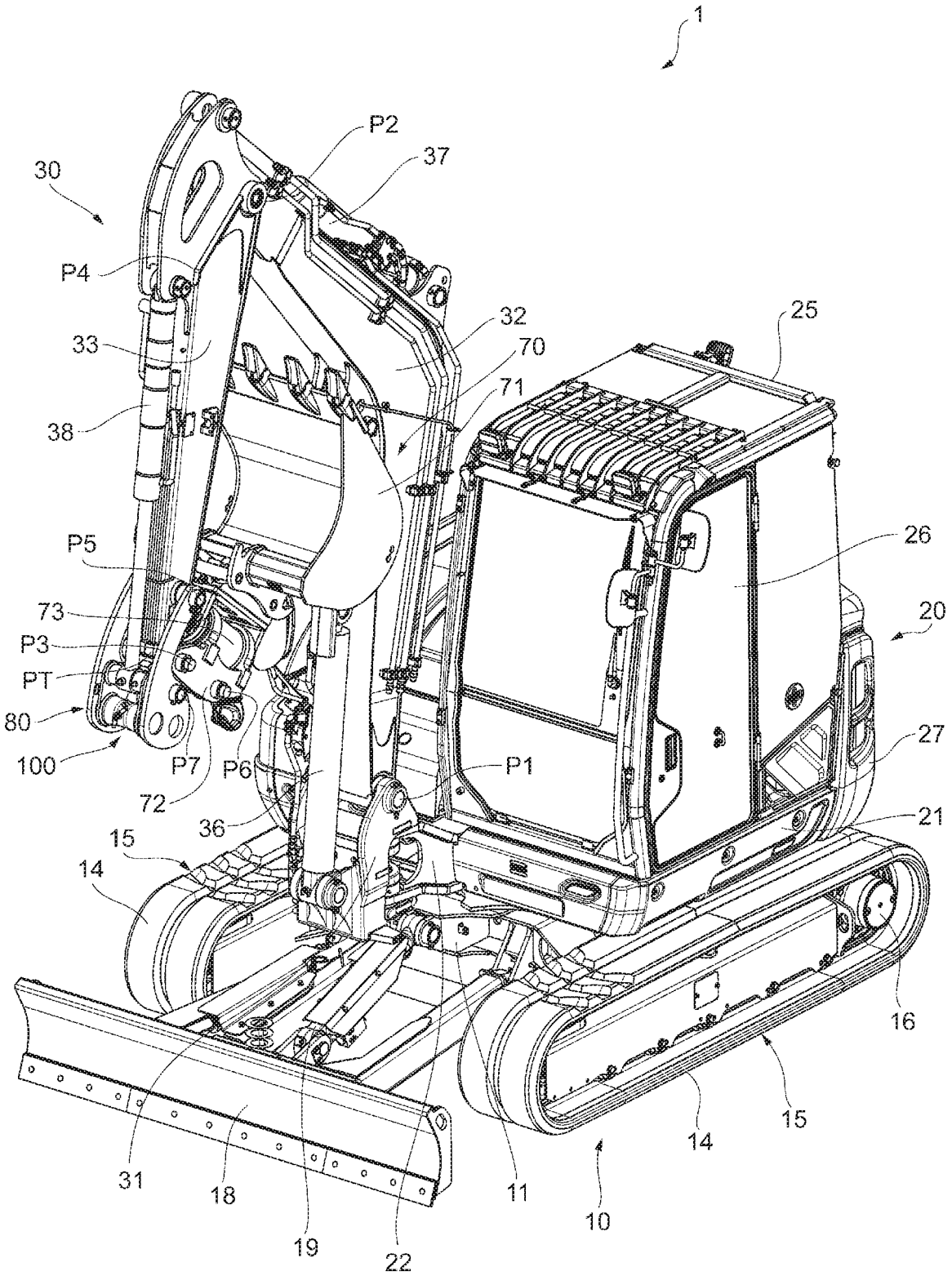
FIG. 1 is a perspective view of a hydraulic shovel comprising a working device according to the present invention.
Figure 2:
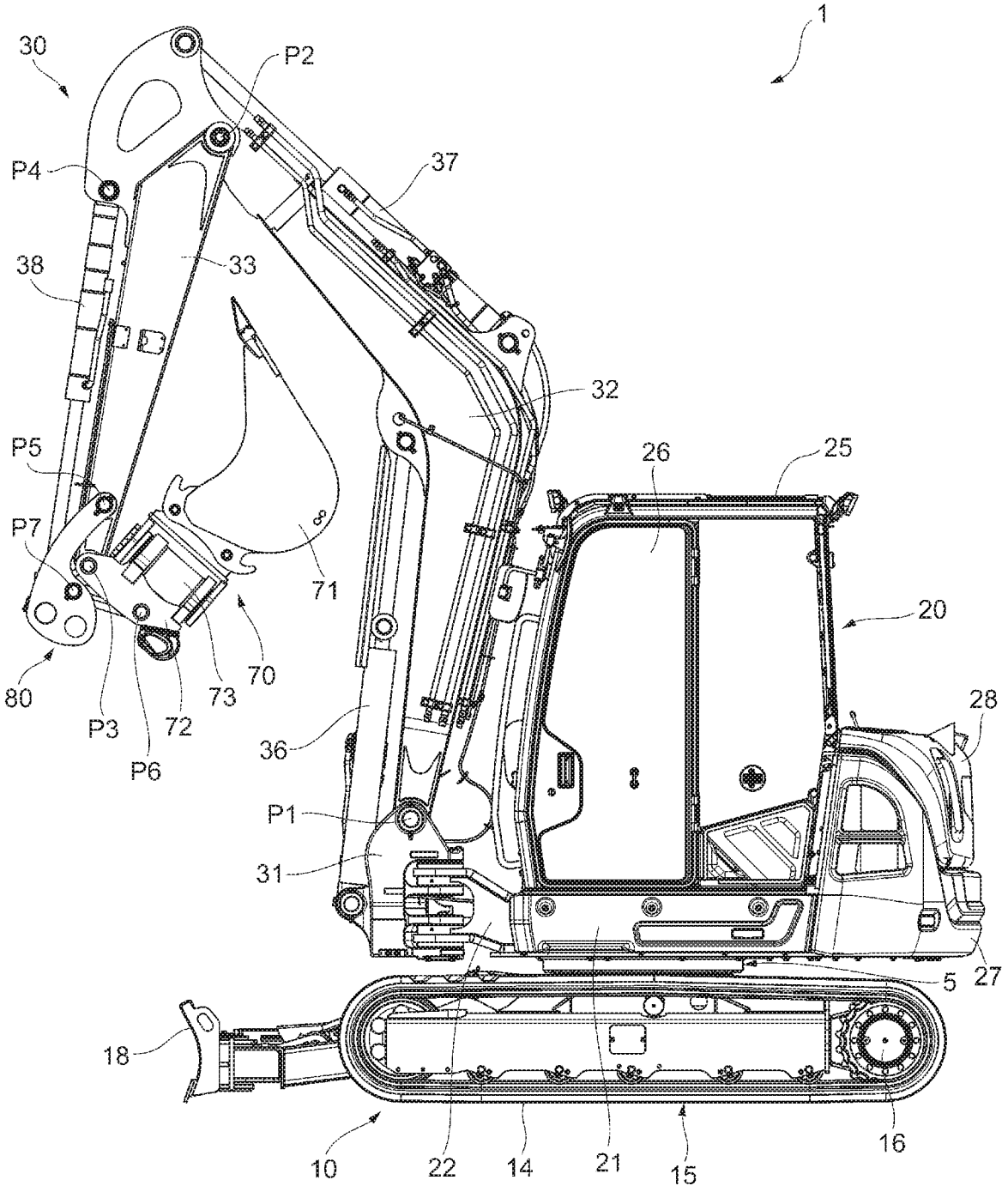
FIG. 2 is aside view of the hydraulic shovel as seen from the left side of the vehicle.
Figure 3:
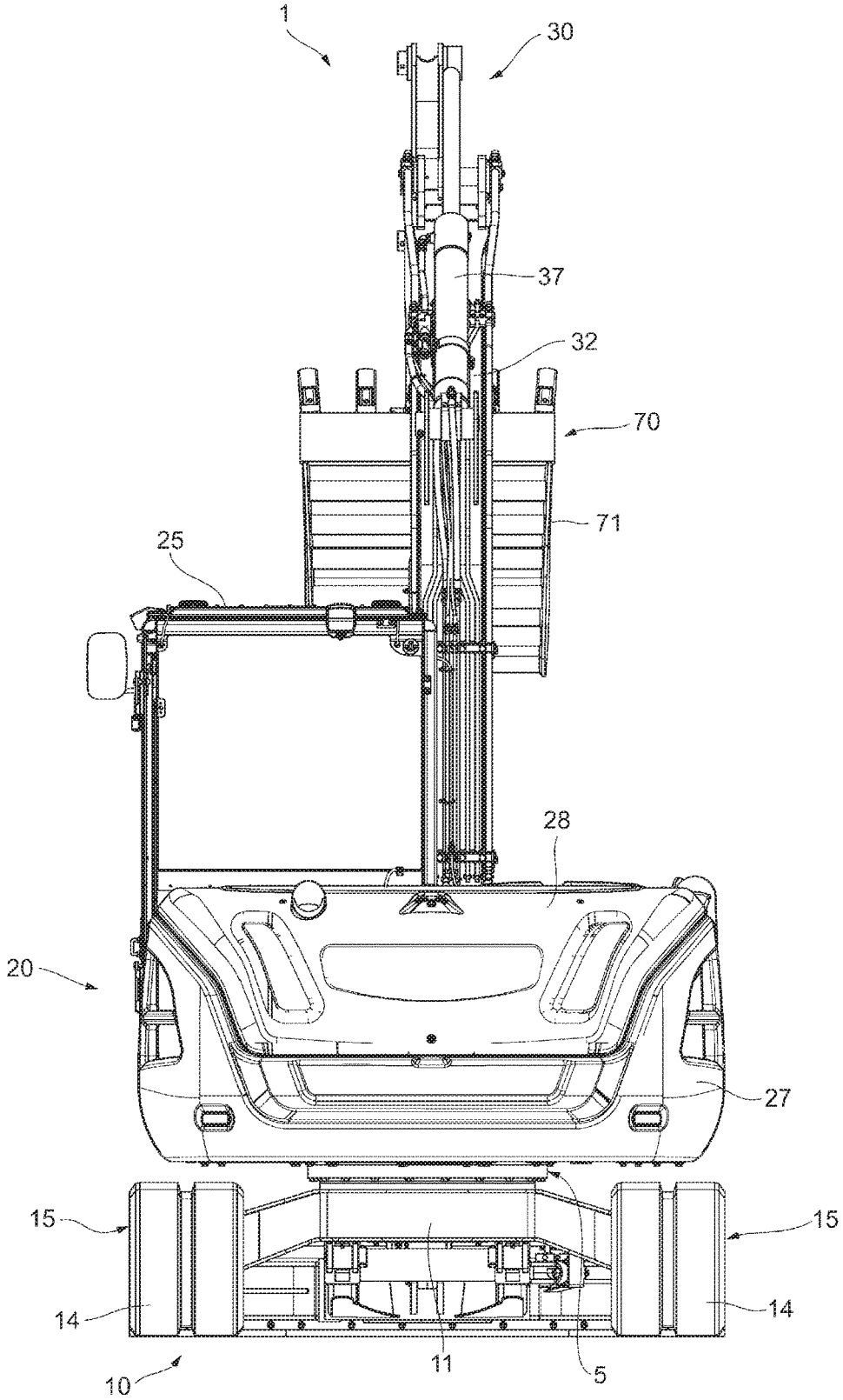
FIG. 3 is a rear view of the hydraulic shovel.

The hydraulic shovel 1 is configured to comprise a movable traveling unit 10, a turning body 20 horizontally pivotally provided on the top of the traveling unit 10, and a shovel device 30 provided on the front of the turning body 20 as shown in FIGS. 1 to 3.

The traveling unit 10 is configured to comprise a pair of left and right crawler mechanisms 15 on both right and left sides of a traveling unit frame 11 which each have a drive wheel, a plurality of slave wheels, and a crawler belt 14 placed around these wheels. The left and right crawler mechanisms 15 comprise left and right traveling motors 16 to rotationally drive the drive wheels. The traveling unit 10 is configured to be movable in any direction and at any speed by controlling the rotational direction and rotational speed of the right and left traveling motors 16. A blade 18 is vertically swingably provided on the front of the traveling unit frame 11. The blade 18 is configured to be vertically swingable by extending and contracting a blade cylinder 19 provided across between the traveling unit frame 11 and the blade.

A turning mechanism 5 is provided in the center of the top of the traveling unit frame 11. The turning mechanism 5 comprises an inner race fixed to the traveling unit frame 11, an outer race fixed to the turning body 20, a turning motor 8 (see FIG. 4) provided in the turning body 20, and a rotary center joint for supplying operating oil from a hydraulic pump 64 (see FIG. 4) provided in the turning body 20 to the right and left traveling motors 16 and blade cylinder 19 provided in the traveling unit 10. The turning body 20 is horizontally pivotally provided via the turning mechanism 5 on the traveling unit frame 11 and is configured to be turnable in right and left directions with respect to the traveling unit 10 by operating the turning motor 8 to rotate normally or reversely.

The turning body 20 comprises a turning body frame 21 horizontally pivotally provided via the turning mechanism 5 on the traveling unit frame 11 and an operator cabin 25 provided on the turning body frame 21. A turning-body-side bracket 22 protruding forward is provided on the front of the turning body frame 21.

The shovel device 30 comprises a shovel-side bracket 31 provided to be swingable in right and left directions with a vertical axis as the center on the turning-body-side bracket 22, a boom 32 provided to be vertically swingable (up/down movable) via a first pivot joint pin P1 on the upper end of the shovel-side bracket 31, and an arm 33 provided to be vertically swingable (bend/stretchable) via a second pivot joint pin P2 on the tip of the boom 32. And the shovel device 30 is configured such that a tilt bucket 70 as an example work attachment can be vertically swingably attached to the tip of the arm 33 via a third pivot joint pin P3. Further, the shovel device 30 comprises a swing cylinder 35 (see FIG. 4) provided across between the turning body frame 21 and the shovel-side bracket 31, a boom cylinder 36 provided across between the shovel-side bracket 31 and the boom 32, an arm cylinder 37 provided across between the boom 32 and the arm 33, a bucket cylinder 38 whose base end (cylinder-side end) is pivotally joined, vertically swingably, to the arm 33 via a fourth pivot joint pin P4, a link mechanism 80 (described in detail later) provided to link the arm 33 and the tilt bucket 70 while the tilt bucket 70 is vertically swingably attached to the tip of the arm 33, and a connection unit 100 (described in detail later) placed between the tip of the bucket cylinder 38 and the link mechanism 80.

The shovel-side bracket 31 is configured to be swingable in right and left directions with respect to the turning-body-side bracket 22 (the turning body frame 21) by operating the swing cylinder 35 to extend and contract. The boom 32 is configured to be swingable upward and downward (up/down movable) with respect to the shovel-side bracket 31 by operating the boom cylinder 36 to extend and contract. The arm 33 is configured to be swingable upward and downward (bend/stretchable) with respect to the boom 32 by operating the arm cylinder 37 to extend and contract. The tilt bucket 70 is configured to be vertically swingable with respect to the arm 33 via the link mechanism 80 and connection unit 100 by operating the bucket cylinder 38 to extend and contract.

The tilt bucket 70 comprises a bucket main body 71, a bucket bracket 72 to hold the bucket main body 71 swingably in right and left directions, and a for-tilting hydraulic actuator 73 provided between the bucket main body 71 and the bucket bracket 72 to make the bucket main body 71 swing in right and left directions with respect to the bucket bracket 72. Instead of the tilt bucket 70, various attachments such as a normal bucket, breaker, crusher, cutter, and auger device can be vertically swingably attached to the tip of the arm 33 and the link mechanism 80. In the tip of the upper surface of the arm 33, there are provided a plurality of connection ports PT to which can be connected a hydraulic pressure hose for supplying operating oil to a hydraulic actuator forming part of the attachment when such an attachment is attached (which actuator includes the for-tilting hydraulic actuator 73).

The operator cabin 25 forms an operator room, in which an operator can get, in a substantially rectangular box shape and is provided at the left side with a cabin door 26 which can be laterally opened and closed. Inside the operator cabin 25, there are provided an operator seat on which the operator can sit facing forward, left and right travel operation levers 41, 42 (see FIG. 4) with which to operate the traveling unit 10 to travel, left and right work operation levers 43, 44 (see FIG. 4) with which to operate the turning body 20 to turn and to operate the shovel device 30 to work, a swing operation pedal 45 (see FIG. 4) with which to operate the shovel device 30 to swing (swing to the right and left), a blade operation lever 46 (see FIG. 4) with which to operate the blade 18 to work, a display device to display a variety of vehicle information of the hydraulic shovel 1, and various operation switches to be operated by the operator. A pedal assembly is provided at the lower ends of the travel operation levers 41, 42, and the operator can also operate by foot the traveling unit 10 to travel.

Figure 4:
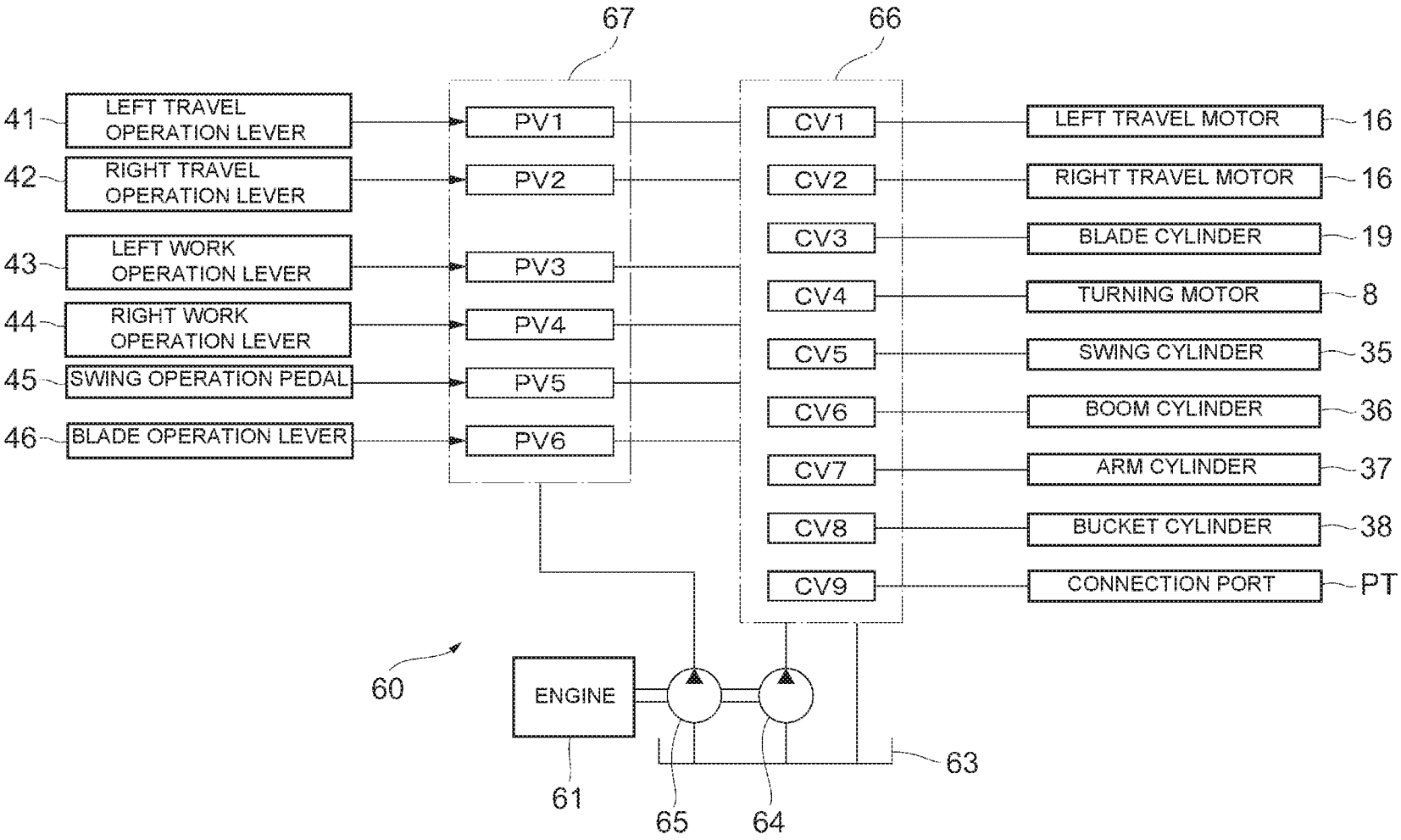
FIG. 4 is a block diagram showing the configuration of a hydraulic drive device of the hydraulic shovel.

In the turning body 20, a mounting room in which to mount a hydraulic drive device 60 (see FIG. 4) is provided behind, and on the right of, the operator cabin 25. In the back wall forming part of the mounting room, a counter weight 27 in a curved surface shape and an engine cover 28 which can be longitudinally opened and closed are provided. The hydraulic drive device 60 comprises an engine 61, an operating oil tank 63 to store operating oil, a hydraulic pump 64 and pilot pump 65 driven by the engine 61, a control valve unit 66 to control the supply direction and supply amount of operating oil discharged from the hydraulic pump 64 and supplied to each hydraulic actuator, and a pilot valve unit 67 to generate pilot pressure to drive the control valve unit 66 as shown in FIG. 4.

The control valve unit 66 comprises left and right travel motors 16, a blade cylinder 19, a turning motor 8, a swing cylinder 35, a boom cylinder 36, an arm cylinder 37, a bucket cylinder 38, and control valves CV1 to CV9 respectively corresponding to the connection ports PT. Each of these control valves CV1 to CV9 controls the supply direction and supply amount of operating oil supplied to a respective hydraulic actuator by the movement of an incorporated spool, where the spool is moved by the pilot pressure supplied from the pilot valve unit 67.

The pilot valve unit 67 comprises a left travel pilot valve unit PV1 provided at the base of the left travel operation lever 41, a right travel pilot valve unit PV2 provided at the base of the right travel operation lever 42, a left work pilot valve unit PV3 provided at the base of the left work operation lever 43, a right work pilot valve unit PV4 provided at the base of the right work operation lever 44, a swing pilot valve unit PV5 provided at the base of the swing operation pedal 45, and a blade pilot valve unit PV6 provided at the base of the blade operation lever 46. These pilot valve units PV1 to PV6 are each configured to comprise a plurality of pilot valves and to generate pilot pressure according to the incline operation direction and operation amount of the respective operation lever or the like based on pressured oil supplied from the pilot pump 65 to supply to the corresponding control valve.

In the hydraulic shovel 1 configured in this way, when the left and right travel operation levers 41, 42 provided in front of the operator seat in the operator cabin 25 are inclined back and forth in operation, the left and right travel pilot valve units PV1, PV2 generate pilot pressure according to the operation directions and operation amounts thereof. Then the control valves CV1, CV2 corresponding to the left and right travel motors 16 are driven by that pilot pressure, so that operating oil is supplied to the left and right travel motors 16. As such, the hydraulic shovel 1 is configured to be able to travel by making the left and right crawler mechanisms 15 operate in the travel directions and at the travel speeds according to the operation directions and operation amounts of the left and right travel operation levers 41, 42.

When the left and right work operation levers 43, 44 provided on the left and right of the operator seat are inclined back, forth, leftward, and rightward in operation, the left and right work pilot valve units PV3, PV4 generate pilot pressure according to the operation directions and operation amounts thereof. Then the control valves CV4, CV6 to CV9 corresponding to the turning motor 8, boom cylinder 36, arm cylinder 37, bucket cylinder 38, and connection ports PT are driven by that pilot pressure, so that operating oil is supplied to the hydraulic actuators corresponding to the operation directions of the left and right work operation levers 43, 44. When the swing operation pedal 45 is stepped on leftward, and rightward in operation, the swing pilot valve unit PV5 generates pilot pressure according to the operation direction and operation amount thereof, and the control valve CV5 is driven by that pilot pressure, so that operating oil is supplied to the swing cylinder 35. When the blade operation lever 46 is inclined back and forth in operation, the blade pilot valve unit PV6 generates pilot pressure according to the operation direction and operation amount thereof, and the control valve CV3 is driven by that pilot pressure, so that operating oil is supplied to the blade cylinder 19. As such, the hydraulic shovel 1 is configured to be able to perform excavation or the like by making the turning body 20, the shovel device 30, and the blade 18 operate in the operation directions and at the operation speeds according to the operation directions and operation amounts of the left and right work operation levers 43, 44, the swing operation pedal 45, and the blade operation lever 46.

Figure 5:
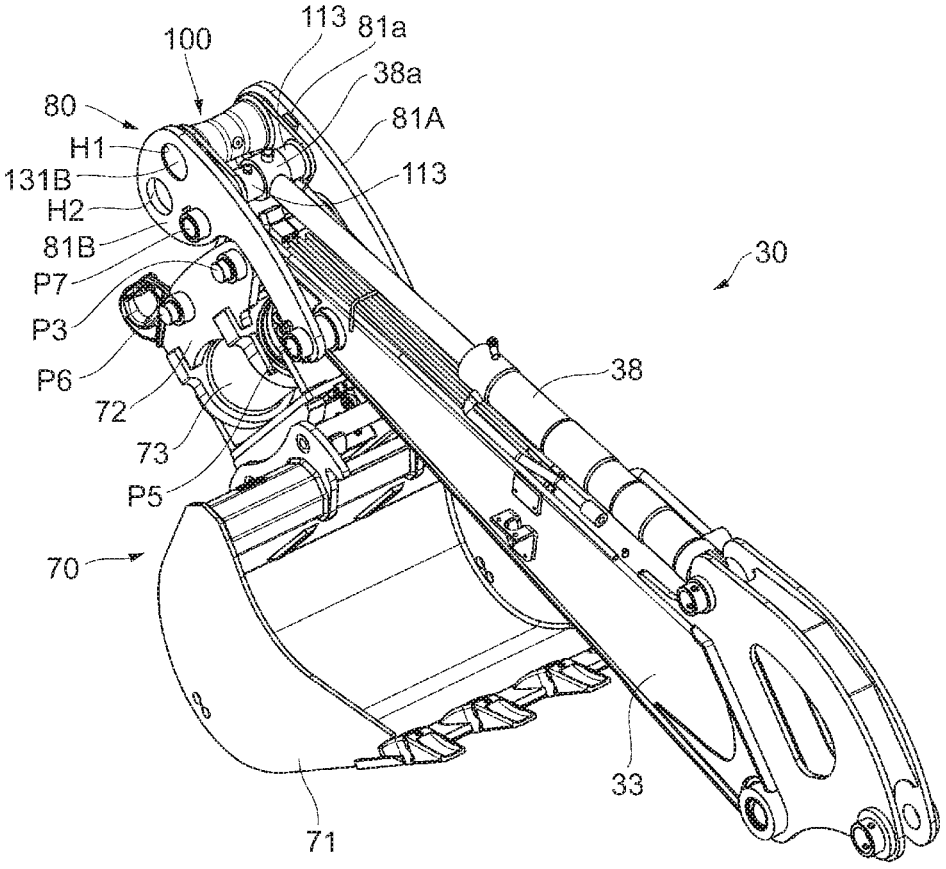
FIG. 5 is a perspective view showing the configuration of a link mechanism of the working device.
Figure 6:
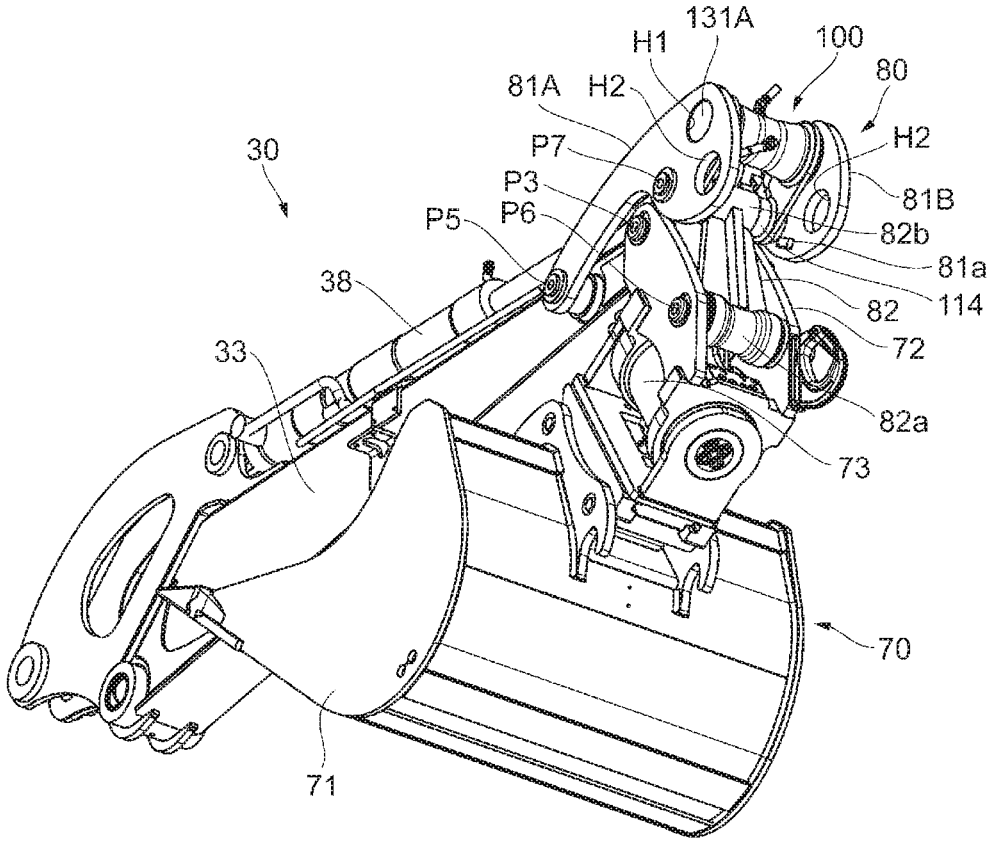
FIG. 6 is another perspective view showing the configuration of the link mechanism.
Figure 7:
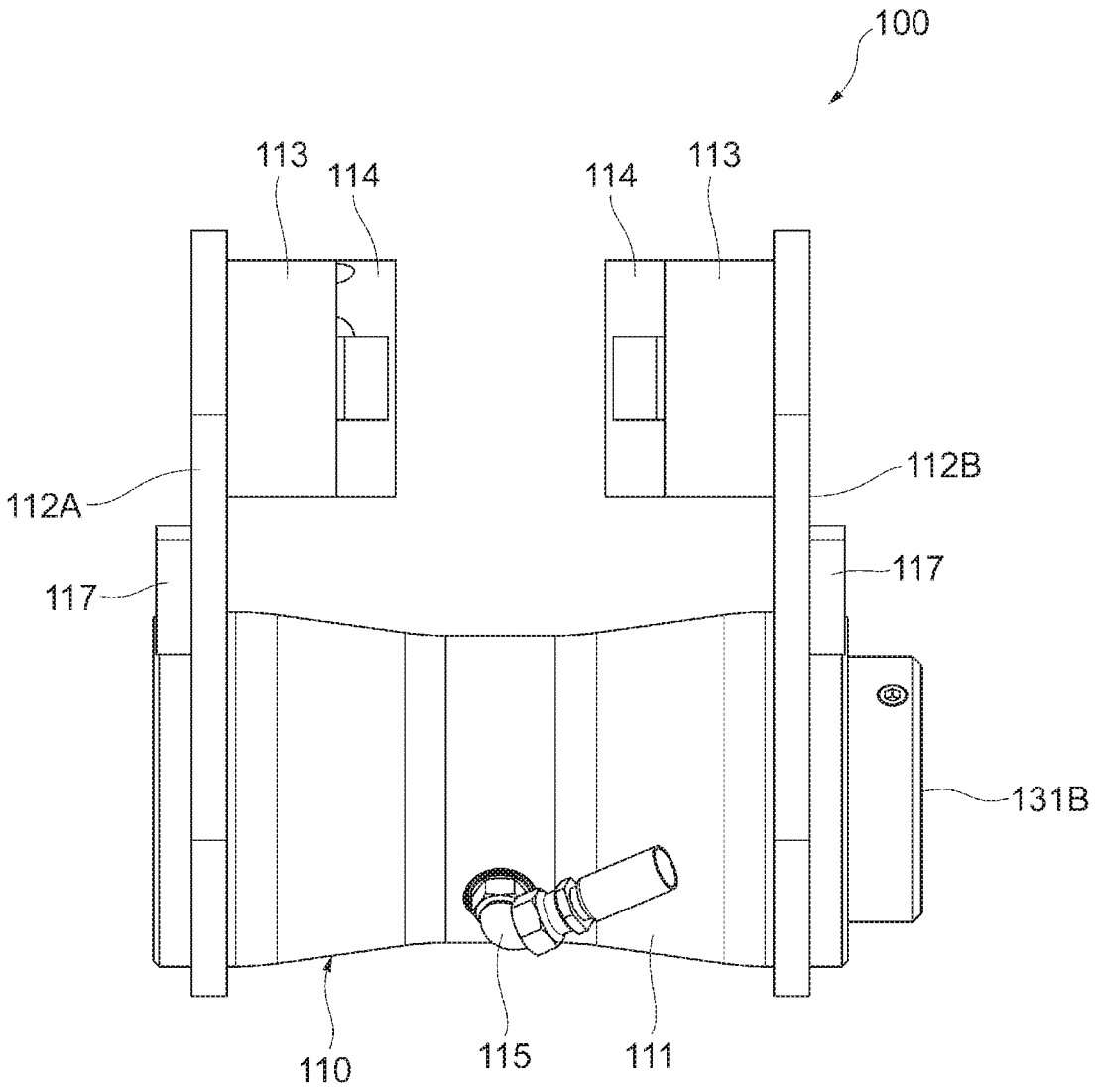
FIG. 7 is a plan view of a connection unit of the working device.
Figure 8:
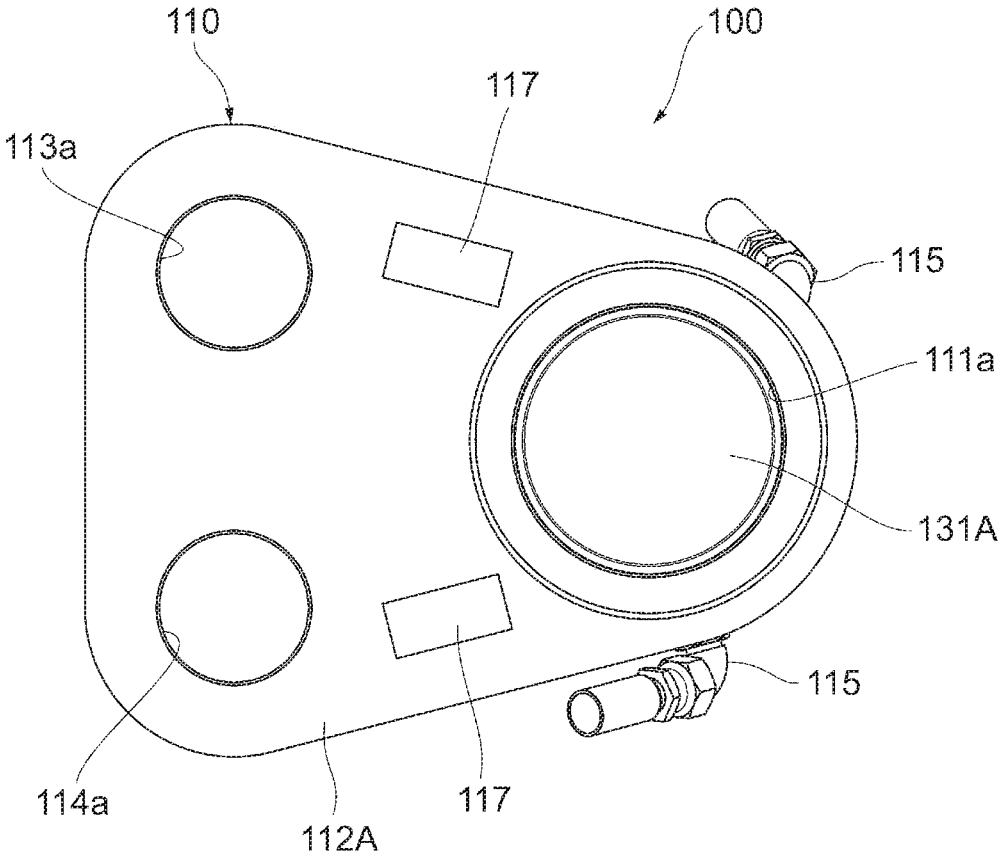
FIG. 8 is a side view of the connection unit.

Next, the configuration of the link mechanism 80 will be described in detail with further reference to FIGS. 5 and 6. As shown in FIGS. 5 and 6, the link mechanism 80 is configured to comprise a pair of left and right first link members 81A, 81B and a second link member 82. The first link members 81A, 81B have a shape in which one end side (the base end side) is thin while the other end side (the distal side) is circular and broad. The first link members 81A, 81B each have a pivot joint hole (not shown) formed in their base end, which hole extends through in a left-to-right direction, and are pivotally joined, vertically swingably, to the arm 33 via a fifth pivot joint pin P5 inserted into the pivot joint holes. More specifically, the first link member 81A is pivotally joined to the right side of the arm 33, and the first link member 81B is pivotally joined to the left side of the arm 33. Further, two connection holes H1, H2 extending through in the left-to-right direction are provided in the distal part of each of the first link members 81A, 81B.

The second link member 82 has a shape extending generally linearly as shown in FIG. 6 and comprises a cylindrical pin receiving portion 82*a* at one end (closer to the bucket bracket 72) and a cylindrical pin receiving portion 82*b* at the other end (closer to the first link members 81A, 81B). A pivot joint hole (not shown) extending through in the left-to-right direction is formed in the pin receiving portion 82*a*, and the second link member 82 is pivotally joined, vertically swingably, at one end to the bucket bracket 72 via a sixth pivot joint pin P6 inserted into that pivot joint hole. Likewise, a pivot joint hole (not shown) extending through in the left-to-right direction is formed also in the pin receiving portion 82*b*, and the second link member 82 is pivotally joined, vertically swingably, at the other end to the distal parts of the first link members 81A, 81B via a seventh pivot joint pin P7 inserted into that pivot joint hole. Pivot joint holes (not shown) extending through in the left-to-right direction, into which to insert the seventh pivot joint pin P7, are formed in the first link members 81A, 81B.

Next, the configuration of the connection unit 100 will be described in detail with further reference to FIGS. 7 to 13. The connection unit 100 is configured to comprise a housing 110 (see FIGS. 7 to 10) and a connection pin mechanism 130 (see FIG. 11) provided in the housing 110. The housing 110 comprises a cylindrical housing base 111 extending in the left-to-right direction, side plates 112A, 112B in a rounded triangle shape (see FIG. 8) provided at left and right opposite ends of the housing base 111, cylindrical pin receiving portions 113 provided opposite each other on the inner surfaces of the side plates 112A, 112B, and cylindrical pin receiving portions 114, other than the pin receiving portions 113, provided opposite each other on the inner surfaces of the side plates 112A, 112B.

Figure 9:
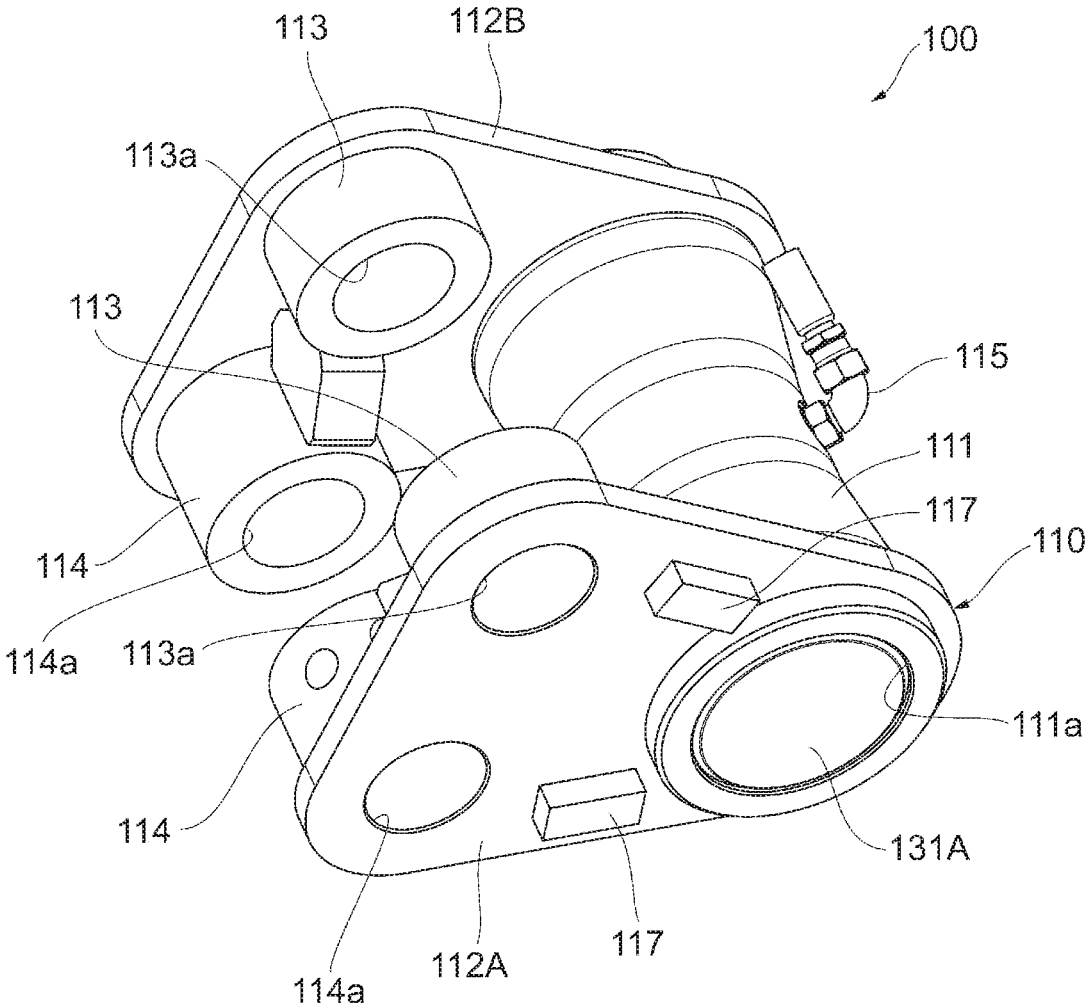
FIG. 9 is a perspective view of the connection unit.
Figure 10:
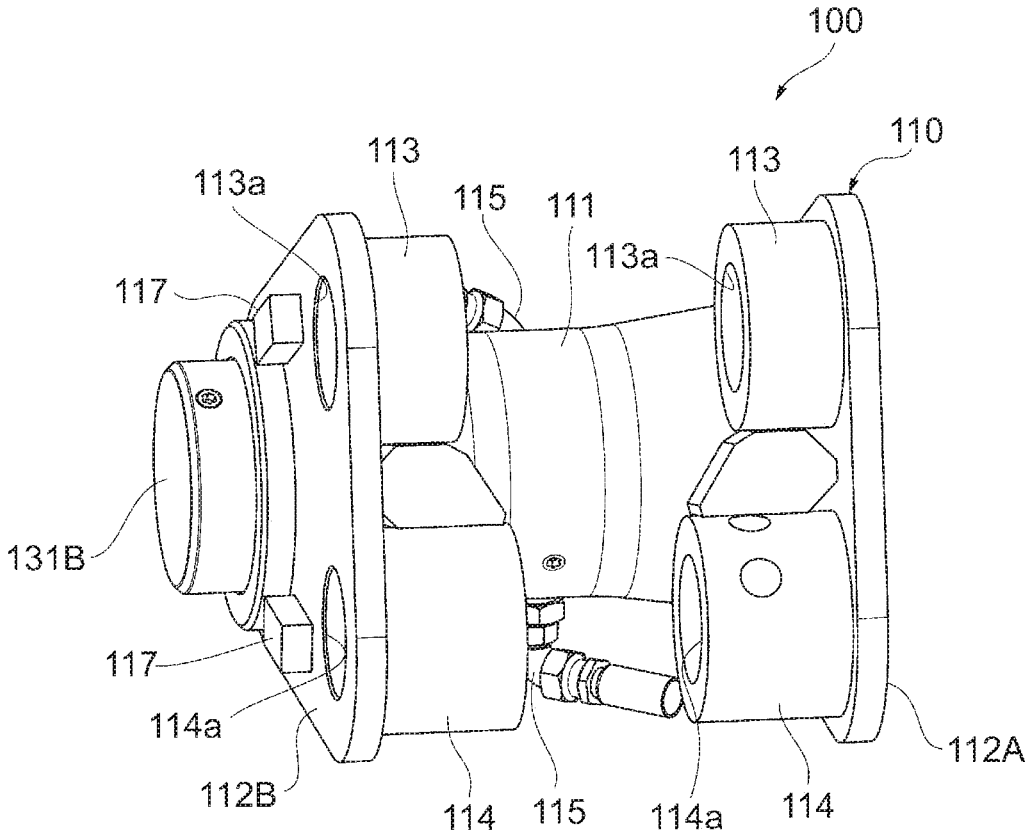
FIG. 10 is another perspective view of the connection unit.

As shown in FIGS. 9 and 10, a pivot joint hole 113*a* extending through in the left-to-right direction and whose one end is open at the outer side surface of the side plate 112A or 112B is formed in the pin receiving portion 113. Likewise, a pivot joint hole 114*a* extending through in the left-to-right direction and whose one end is open at the outer side surface of the side plate 112A or 112B is formed in the pin receiving portion 114. L-shaped tubes 115 to which to connect a hydraulic hose for supplying pressured oil to the connection pin mechanism 130 inside the housing base 111 and discharging pressured oil from the connection pin mechanism 130 are attached to the housing base 111 at two positions along a circumference of the housing base 111.

Figure 11:
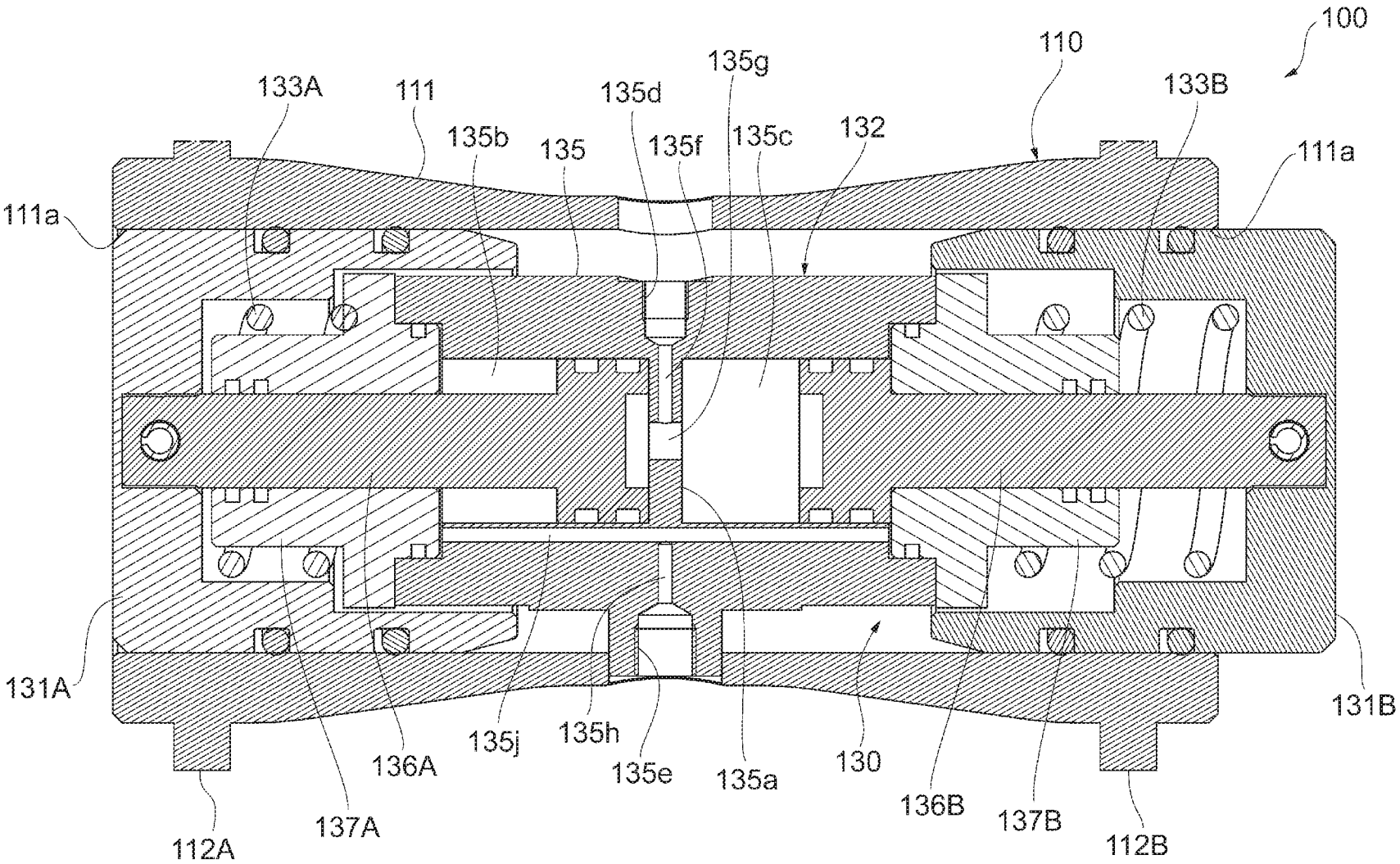
FIG. 11 is a cross-sectional view of a housing base of the connection unit.

As shown in FIG. 11, the connection pin mechanism 130 is stored and held in the housing base 111. The connection pin mechanism 130 is configured to comprise a pair of connection pins 131A, 131B placed bilaterally symmetric, a for-connection-pins hydraulic cylinder 132 to make the connection pins 131A, 131B operate, and coil springs 133A, 133B. The connection pins 131A, 131B are formed in a bottomed cylinder shape in which an end is closed. The connection pins 131A, 131B are configured such that their ends can protrude out of the housing base 111 through for-connection-pins openings 111*a* formed in right and left opposite ends of the housing base 111 and retract into the housing base 111.

The for-connection-pins hydraulic cylinder 132 is configured to comprise a cylinder tube 135 extending in the left-to-right direction, a pair of with-a-rod pistons 136A, 136B placed bilaterally symmetric with respect to the cylinder tube 135, and caps 137A, 137B fixed to right and left opposite ends of the cylinder tube 135 and for guiding piston rods. The cylinder tube 135 has a partition wall 135*a* at the center along the left-to-right direction and is partitioned by the partition wall 135*a* into an oil room 135*b* on the with-a-rod piston 136A side and an oil room 135*c* on the with-a-rod piston 136B side. A first port 135*d* and second port 135*e* for supplying and discharging pressured oil are formed in the cylinder tube 135, and ends of the L-shaped tubes 115 are to be respectively connected to the first port 135*d* and second port 135*e*.

An oil passage 135*f* extending through the partition wall 135*a* is connected to the first port 135*d*, and an oil passage 135*g*, by which the oil room 135*b* and oil room 135*c* communicate, is connected to the oil passage 135*f*. Pressured oil supplied to the first port 135*d* is led via the oil passages 135*f*, 135*g* to an area on the partition wall side (area sandwiched between the piston of the with-a-rod piston 136A and the partition wall 135*a*) of the oil room 135*b* and an area on the partition wall side (area sandwiched between the piston of the with-a-rod piston 136B and the partition wall 135*a*) of the oil room 135*c*. An oil passage 135*h* is connected to the second port 135*e*, and an oil passage 135*j* diverging from the oil passage 135*h* in right and left directions is connected to the oil passage 135*h*. Pressured oil supplied to the second port 135*e* is led via the oil passages 135*h*, 135*j* to an area on the cap side (area sandwiched between the piston of the with-a-rod piston 136A and the cap 137A) of the oil room 135*b* and an area on the cap side (area sandwiched between the piston of the with-a-rod piston 136B and the cap 137B) of the oil room 135*c*.

The connection pins 131A, 131B are swingably joined by pin to the rod tips of the with-a-rod pistons 136A, 136B respectively. When pressured oil is supplied to the first port 135*d*, the with-a-rod pistons 136A, 136B move farther from the partition wall 135*a* by the pressured oil, thereby operating the connection pins 131A, 131B to protrude out of the housing base 111. When pressured oil is supplied to the second port 135*e*, the with-a-rod pistons 136A, 136B move closer to the partition wall 135*a* by the pressured oil, thereby operating the connection pins 131A, 131B to retract into the housing base 111. FIG. 11 shows the state where the connection pin 131A is retracted into the housing base 111 while the connection pin 131B protrudes out of the housing base 111, for convenience.

The coil spring 133A is placed between the connection pin 131A and the cap 137A and biases the connection pin 131A in the direction in which to protrude out of the housing base 111. Likewise, the coil spring 133B is placed between the connection pin 131B and the cap 137B and biases the connection pin 131B in the direction in which to protrude out of the housing base 111. Thus, when the supply of pressured oil to the first port 135*d* and the second port 135*e* stops so that enough oil pressure to oppose the bias of the coil spring 133A, 133B does not act on the with-a-rod piston 136A, 136B, the connection pin 131A, 131B operates to protrude out of the housing base 111 by the bias of the coil spring 133A, 133B.

Figure 12:
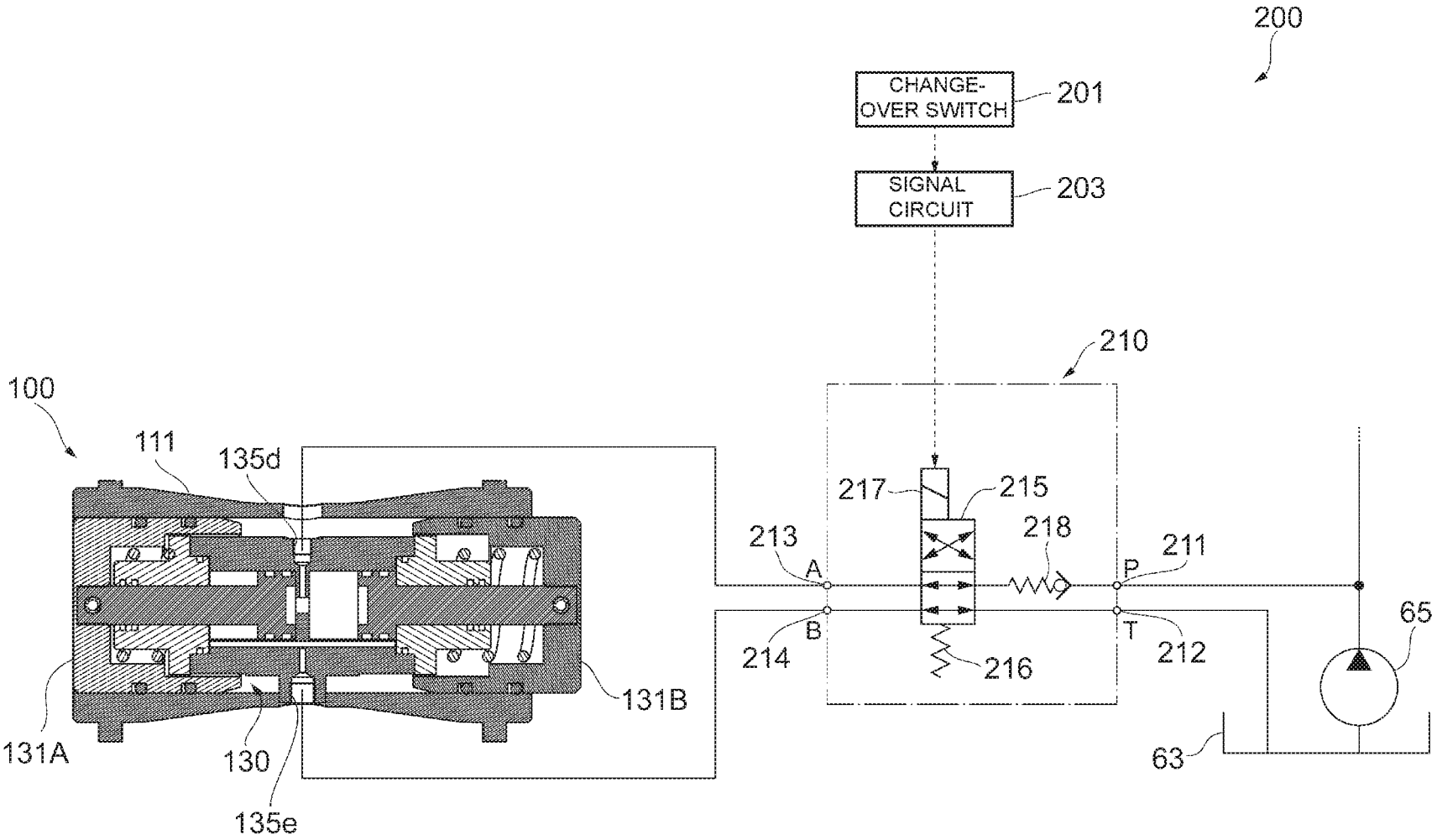
FIG. 12 is a block diagram showing the configuration of a connection pin operation control unit to control the operation of connection pins of the connection unit.

The operation of the connection pins 131A, 131B in the connection pin mechanism 130 is controlled by a connection pin operation control unit 200 shown in FIG. 12. The connection pin operation control unit 200 is configured to comprise a change-over switch 201, a signal circuit 203, and a direction control valve 210. The change-over switch 201 is placed in, e.g., the operator cabin 25 and is an operation switch which is operated to switch between an on-state and an off-state. The signal circuit 203 is configured to output a drive signal to drive a solenoid 217, described later, when the change-over switch 201 is operated to be in the on-state.

The direction control valve 210 comprises a P port 211 connected to the supply passage of pressured oil (pilot oil) supplied from the pilot pump 65, a T port 212 connected to the return passage of pressured oil to the operating oil tank 63, an A port 213 connected to the first port 135*d* of the connection pin mechanism 130, and a B port 214 connected to the second port 135*e* of the connection pin mechanism 130. Further, the direction control valve 210 comprises a two-position switching spool 215, a spring 216 to bias the spool 215 to move to a first position (where the P port 211 and A port 213 are connected while the B port 214 and T port 212 are connected), the solenoid 217 to move the spool 215 against the bias of the spring 216 to a second position (where the P port 211 and B port 214 are connected while the A port 213 and T port 212 are connected), and a with-a-spring check valve 218 to prevent the reverse flow of pressured oil from the connection pin mechanism 130 to the P port 211.

In the connection pin operation control unit 200 configured in this way, when the change-over switch 201 is operated to be in the on-state, the signal circuit 203 outputs a drive signal to drive the solenoid 217. By driving the solenoid 217, the spool 215 moves to the second position, so that the P port 211 and B port 214 are connected and that the A port 213 and T port 212 are connected. Thus, pressured oil is supplied to the second port 135*e* of the connection pin mechanism 130 while pressured oil is discharged from the first port 135*d*, so that the connection pins 131A, 131B operate to retract into the housing base 111. On the other hand, when the change-over switch 201 is operated to be in the off-state, the signal circuit 203 stops outputting the drive signal, so that the solenoid 217 is not driven. Thus, by the bias of the spring 216, the spool 215 moves to the first position, so that the P port 211 and A port 213 are connected and that the B port 214 and T port 212 are connected. Thus, pressured oil is supplied to the first port 135*d* of the connection pin mechanism 130 while pressured oil is discharged from the second port 135*e*, so that the connection pins 131A, 131B operate to protrude out of the housing base 111.

The connection unit 100 configured as above is configured to be connectable to the link mechanism 80 (especially the first link members 81A, 81B) and such that the connection position (connected state) can be switched selectively between a plurality of positions (states). Further, the connection unit 100 is configured to transmit the output of the bucket cylinder 38 to the link mechanism 80 when being connected to the link mechanism 80. This point will be described in detail below. Note that a cylindrical pin receiving portion 38*a* (see FIG. 5) having a pivot joint hole (not shown) extending through in the left-to-right direction is provided at the tip of the bucket cylinder 38.

The connection unit 100 is pivotally joined, vertically swingably, to the tip of the bucket cylinder 38. Specifically, with the pin receiving portion 38*a* at the tip of the bucket cylinder 38 being located between the pair of pin receiving portions 113 provided on the side plates 112A, 112B of the housing 110 of the connection unit 100, by inserting an eighth pivot joint pin P8 (see FIG. 13) into the pivot joint hole of the pin receiving portion 38*a* and the pivot joint holes of the pair of pin receiving portions 113, the connection unit 100 (the housing 110) is pivotally joined to the tip of the bucket cylinder 38 (see FIG. 5). This eighth pivot joint pin P8 does not pivotally join the first link members 81A, 81B thereto.

Further, the connection unit 100 is pivotally joined, vertically swingably, to the first link members 81A, 81B by the seventh pivot joint pin P7 pivotally joining the first link members 81A, 81B and the second link member 82. That is, the connection unit 100, the first link members 81A, 81B, and the second link member 82 are pivotally joined to each other on one pivot joint axis line extending in the left-to-right direction (the axis line of the seventh pivot joint pin P7). Specifically, the connection unit 100 (the housing 110) is positioned between the first link members 81A, 81B, and the pin receiving portion 82*b* of the second link member 82 is positioned between the pair of pin receiving portions 114 (see FIG. 9) provided on the side plates 112A, 112B of the housing 110. Then by inserting the seventh pivot joint pin P7 into the pivot joint holes respectively formed in the first link members 81A, 81B and into which to insert the seventh pivot joint pin P7, the pivot joint holes of the pair of pin receiving portions 114 of the side plates 112A, 112B, and the pivot joint hole of the pin receiving portion 82*b* of the second link member 82, the connection unit 100 (the housing 110) is pivotally joined to the first link members 81A, 81B (see FIG. 6).

Further, in the connection unit 100, by operating the connection pins 131A, 131B of the connection pin mechanism 130, the connection pin 131A, 131B can be inserted into and pulled out of the connection hole H1 or H2 of the first link members 81A, 81B. Specifically, with the connection pins 131A, 131B being opposite the connection holes H1 of the first link members 81A, 81B, by operating the connection pins 131A, 131B to protrude out of the housing base 111, the connection pins 131A, 131B are inserted into the connection holes H1, and by operating the connection pins 131A, 131B to be pulled into the housing base 111, the connection pins 131A, 131B are pulled out of the connection holes H1. Likewise, with the connection pins 131A, 131B being opposite the connection holes H2 of the first link members 81A, 81B, by operating the connection pins 131A, 131B to protrude out of the housing base 111, the connection pins 131A, 131B are inserted into the connection holes H2, and by operating the connection pins 131A, 131B to retract into the housing base 111, the connection pins 131A, 131B are pulled out of the connection holes H2. By inserting the connection pins 131A, 131B into the connection holes H1 or H2, the connection unit 100 is connected to the first link members 81A, 81B via the connection pins 131A, 131B.

By switching between the connection pins 131A, 131B being inserted into the connection holes H1 and being inserted into the connection holes H2 (hereinafter called "connection position switching"), the connection position of the connection unit 100 and the first link members 81A, 81B by the connection pins 131A, 131B can be switched selectively between the position of the connection hole H1 and the position of the connection hole H2. In other words, by connection position switching, the connected state of the connection unit 100 and the first link members 81A, 81B can be switched selectively between a first connected state and a second connected state. The first connected state is the state where the connection unit 100 is pivotally joined to the first link members 81A, 81B via the seventh pivot joint pin P7 and connected to the first link members 81A, 81B at the position of the connection hole H1 via the connection pins 131A, 131B. The second connected state is the state where the connection unit 100 is connected to the first link members 81A, 81B via the seventh pivot joint pin P7 and connected to the first link members 81A, 81B at the position of the connection hole H2 via the connection pins 131A, 131B.

Next, the way that the operation performance of the tilt bucket 70 differs upon the connection position switching will be described with further reference to FIGS. 14 to 17. In FIGS. 14 to 17, neither the first link member 81A nor the connection pin 131A are shown, but in the description below "the first link member 81A, 81B" and "the connection pin 131A, 131B" are cited.

Figure 14:
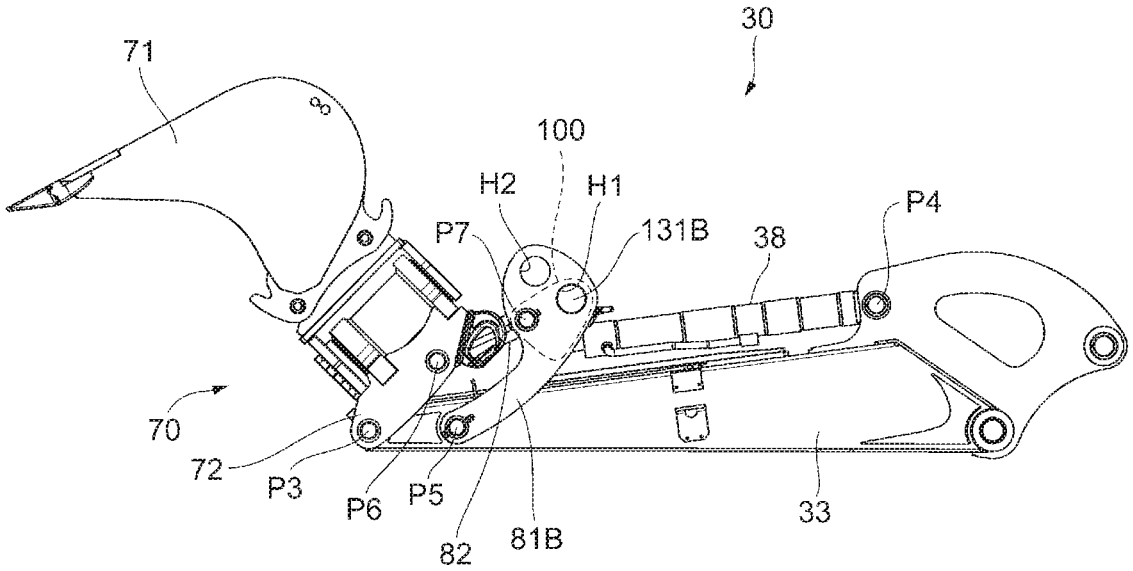
FIG. 14 is a diagram showing a swing state of a tilt bucket attached to the working device when the connection unit is in a first connected state.
Figure 15:
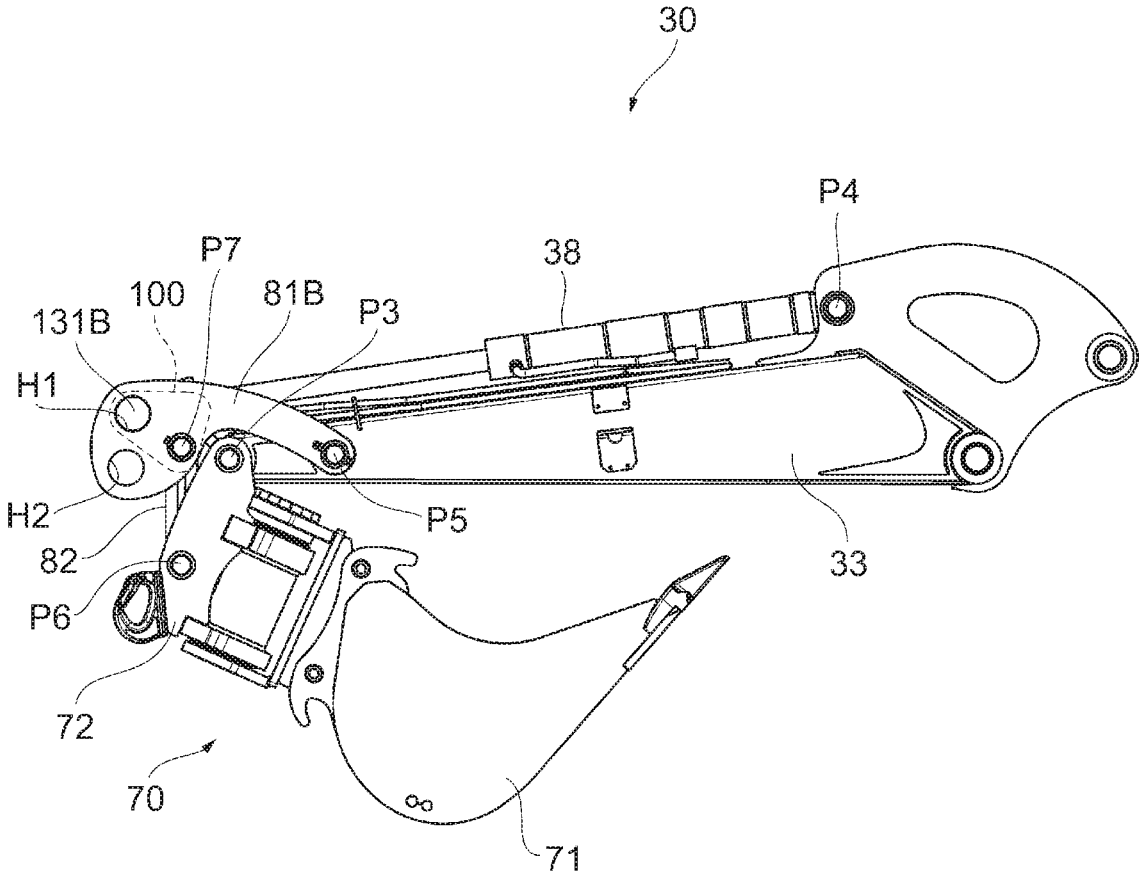
FIG. 15 is a diagram showing another swing state of the tilt bucket attached to the working device when the connection unit is in the first connected state.
Figure 16:
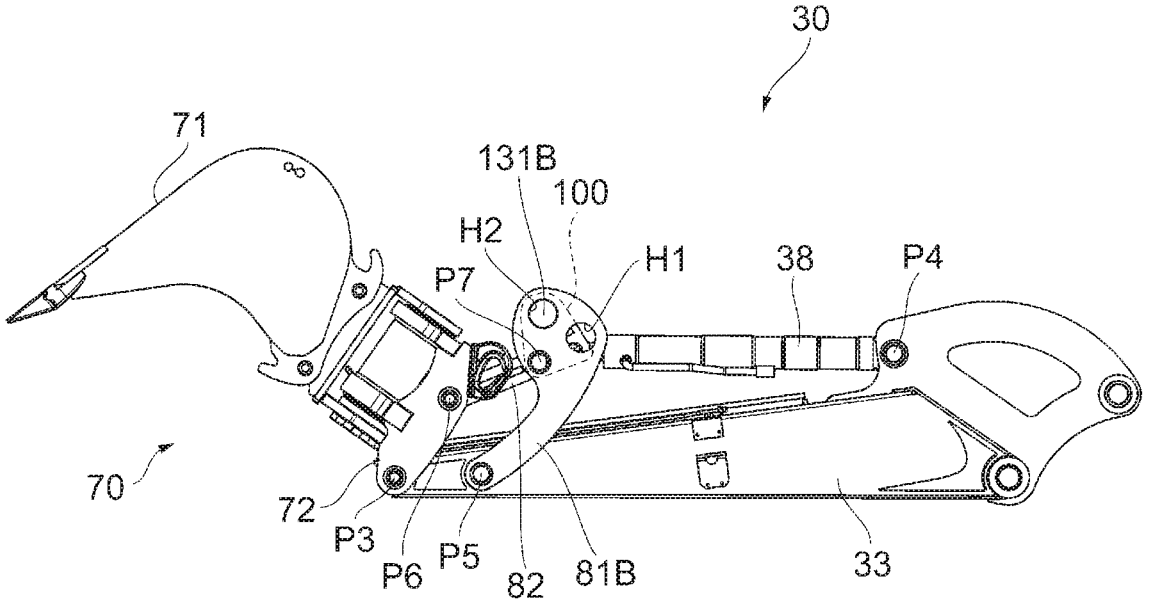
FIG. 16 is a diagram showing a swing state of the tilt bucket attached to the working device when the connection unit is in a second connected state.
Figure 17:
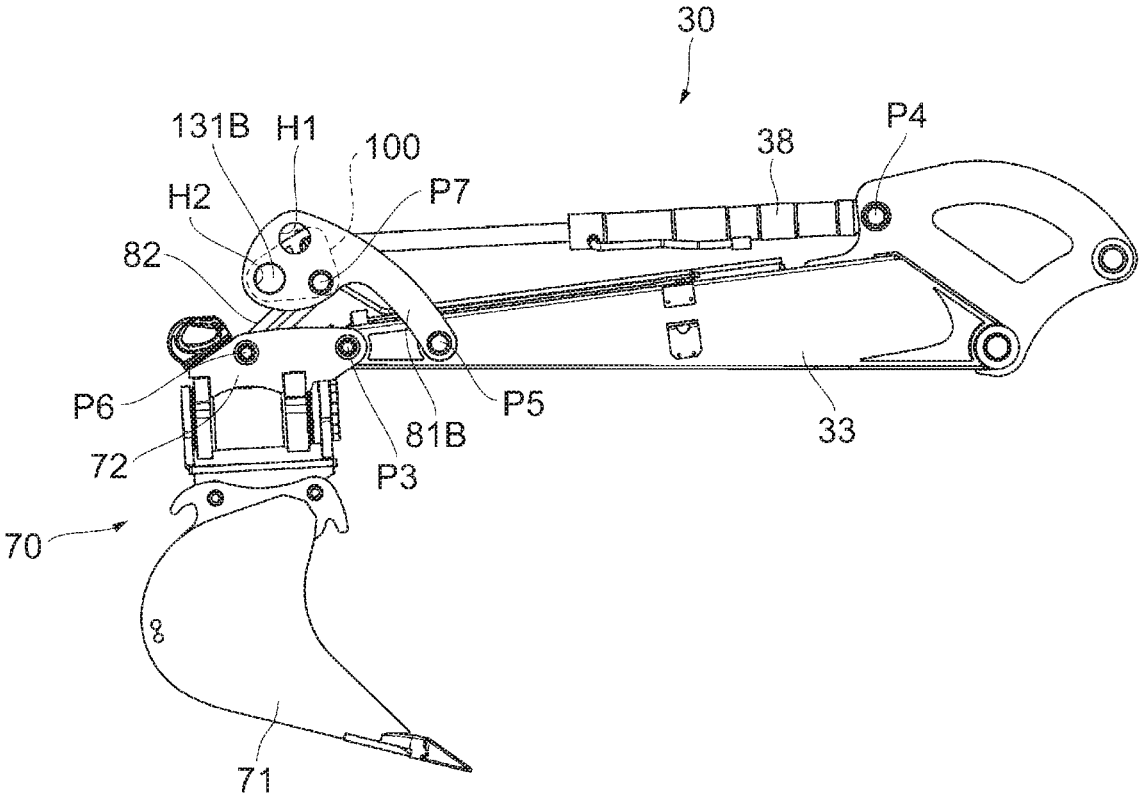
FIG. 17 is a diagram showing another swing state of the tilt bucket attached to the working device when the connection unit is in the second connected state.

FIGS. 14 and 15 show states where the connection pin 131A, 131B of the connection unit 100 is inserted into the connection hole H1 of the first link member 81A, 81B. FIG. 14 shows a state where the bucket cylinder 38 is contracted, and FIG. 15 shows a state where the bucket cylinder 38 is extended. FIGS. 16 and 17 show states where the connection pin 131A, 131B of the connection unit 100 is inserted into the connection hole H2 of the first link member 81A, 81B. FIG. 16 shows a state where the bucket cylinder 38 is contracted, and FIG. 17 shows a state where the bucket cylinder 38 is extended.

In the state where the connection pin 131A, 131B of the connection unit 100 is inserted into the connection hole H1 or H2 of the first link member 81A, 81B (hereinafter called a "unit connected state"), the connection unit 100 can operate integrally with the first link member 81A, 81B. Further, in the unit connected state, when the bucket cylinder 38 operates to extend and contract, the output from the bucket cylinder 38 in the extension-contraction operation is transmitted as torque around the third pivot joint axis P3 to the tilt bucket 70 via the connection unit 100, the first link member 81A, 81B, and the second link member 82, so that the tilt bucket 70 vertically swings around the third pivot joint axis P3 with respect to the arm 33.

In the present embodiment, as shown in FIGS. 14 to 17, the working device is configured such that, in the first connected state where the connection pin 131A, 131B of the connection unit 100 is inserted into the connection hole H1 of the first link member 81A, 81B, the swing range of the tilt bucket 70 according to the extension-contraction operation of the bucket cylinder 38 is wider than in the second connected state where the connection pin 131A, 131B is inserted into the connection hole H2. In contrast, the working device is configured such that, in the second connected state, torque transmitted to the tilt bucket 70 when the bucket cylinder 38 is extended is increased over the first connected state so that the excavating force of the tilt bucket 70 is increased.

Next, the procedure of the connection position switching will be described. Here an example procedure of switching from the first connected state to the second connected state will be described. This connection position switching can be performed whether the tilt bucket 70 is attached to the tip of the arm 33 or not.

First, by operating the change-over switch 201 of the connection pin operation control unit 200 to be in the on-state, the connection pins 131A, 131B of the connection unit 100 are operated to be retracted into the housing base 111, so that the connection pins 131A, 131B are pulled out of the connection holes H1 of the first link members 81A, 81B. By this pulling-out, the connection unit 100 is released from being connected by the connection pins 131A, 131B to the first link members 81A, 81B (hereinafter called a "connection pin unconnected state"). In this connection pin unconnected state, the connection unit 100 is swingable around the seventh pivot joint pin P7 with respect to the first link members 81A, 81B.

Next, the connection pins 131A, 131B of the connection unit 100 are aligned with the connection holes H2 of the first link members 81A, 81B so that the connection pins 131A, 131B are opposite the connection holes H2. In the present embodiment, the connection holes H1, H2 are placed on the same circumference having as the center the pivot joint axis line of the connection unit 100 and the first link members 81A, 81B (the axis line of the seventh pivot joint pin P7). That is, the distance from this pivot joint axis line to the center axis line of the connection hole H1 and the distance to the center axis line of the connection hole H2 are equal. Thus, the alignment of the connection pins 131A, 131B with the connection holes H2 is easily performed by operating the bucket cylinder 38 to extend and contract so as to swing the connection unit 100 around the seventh pivot joint pin P7 with respect to the first link members 81A, 81B. That is, when the connection unit 100 in the connection pin unconnected state is swung around the seventh pivot joint pin P7, the connection pins 131A, 131B automatically become opposite the connection holes H2 (the connection pins 131A, 131B align with the connection holes H2), so that the connection pins 131A, 131B can be easily aligned with the connection holes H2.

Figure 13:
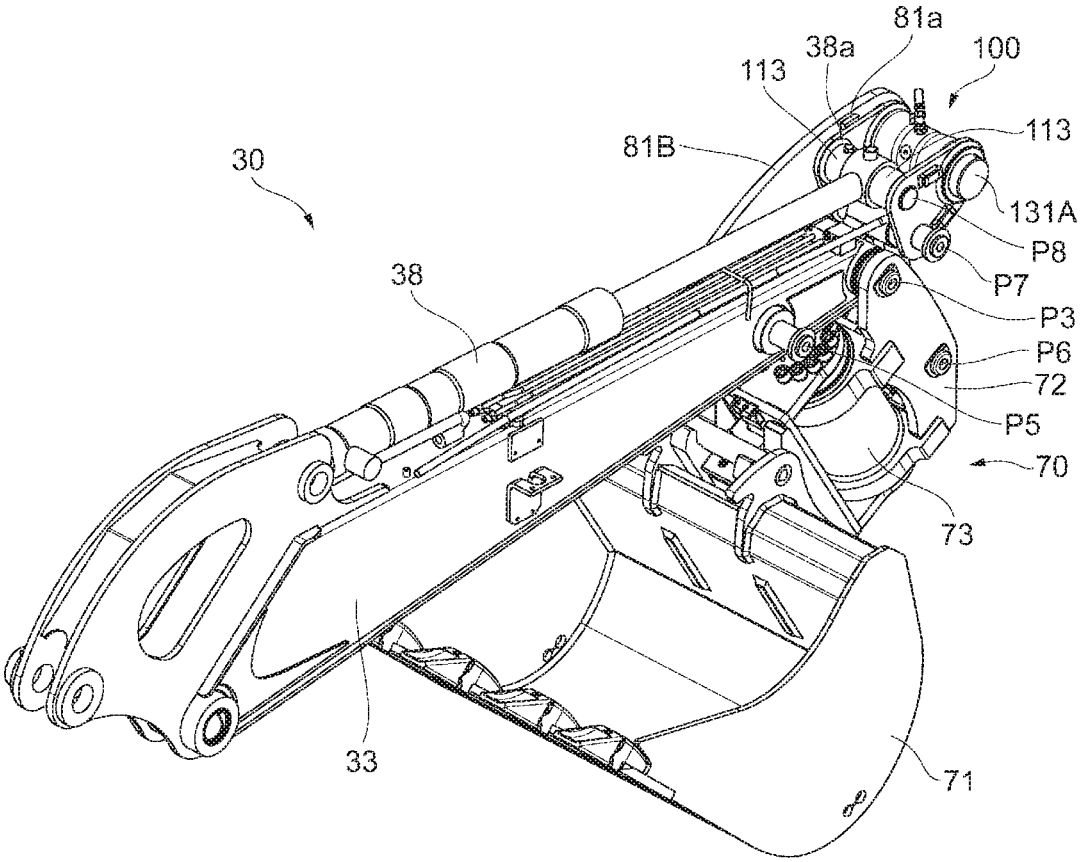
FIG. 13 is a perspective view showing the state where the connection unit is pivotally joined to the tip of a bucket cylinder with a first link member on the right side of the vehicle being removed.

In the present embodiment, a stopper 117 for alignment is provided on the outer side surface of the side plate 112A, 112B of the connection unit 100 (see FIGS. 9 and 10). This stopper 117 is provided at two positions, a position closer to the pivot joint hole 113*a* and a position closer to the pivot joint hole 114*a*. Meanwhile, a similar stopper 81*a* is provided on the inner side surface of the first link member 81A, 81B at two positions, a position closer to the connection hole H1 and a position closer to the connection hole H2 (part of which is shown in FIGS. 5, 6, and 13). The stopper 117 provided closer to the pivot joint hole 114*a* of the connection unit 100 and the stopper 81*a* provided closer to the connection hole H2 of the first link member 81A, 81B are arranged such that they abut on each other when the connection pin 131A, 131B aligns with the connection hole H2, thus restricting the swings of the connection unit 100 around the seventh pivot joint pin P7. Likewise, the stopper 117 provided closer to the pivot joint hole 113*a* of the connection unit 100 and the stopper 81*a* provided closer to the connection hole H1 of the first link member 81A, 81B are arranged such that they abut on each other when the connection pin 131A, 131B aligns with the connection hole H1, thus restricting the swings of the connection unit 100 around the seventh pivot joint pin P7. Since these stoppers 81*a*, 117 are provided, aligning the connection unit 100 with the first link member 81A, 81B can be performed further easily.

After the alignment of the connection pins 131A, 131B with the connection holes H2 finishes, by operating the change-over switch 201 of the connection pin operation control unit 200 to be in the off-state, the connection pins 131A, 131B of the connection unit 100 are operated to protrude out of the housing base 111, so that the connection pins 131A, 131B are inserted into the connection holes H2 of the first link members 81A, 81B. Thereby, switching from the first connected state to the second connected state finishes. Since switching from the second connected state to the first connected state can be performed with a procedure similar to the above-described procedure, description thereof is omitted.

In the working device 30 configured as above, by switching the connected state of the connection unit 100 and the first link members 81A, 81B selectively, the operation performance (the swing range and excavating force) of the tilt bucket 70 vertically swingably attached to the tip of the arm 33 can be switched. Switching the connected state can be easily performed by performing in combination operating the change-over switch 201 of the connection pin operation control unit 200 to be on/off so as to operate the connection pins 131A, 131B of the connection unit 100 and operating the bucket cylinder 38 to extend and contract so as to swing the connection unit 100 in the connection pin unconnected state around the seventh pivot joint pin P7.

When the bucket cylinder 38 is operated to extend and contract in the first connected state or the second connected state, a radial load in a direction perpendicular to the axis line direction thereof acts on the connection pins 131A, 131B of the connection unit 100. The connection unit 100 is configured such that the connection pins 131A, 131B are swingably joined by pin to the rod tips of the with-a-rod pistons 136A, 136B and that the radial load acting on the connection pins 131A, 131B is supported by the housing base 111 and does not act on the with-a-rod pistons 136A, 136B. Therefore, a fault, which would occur if such a radial load acted on the with-a-rod piston 136A, 136B, can be prevented from occurring in the for-connection-pins hydraulic cylinder 132.

The connection pins 131A, 131B of the connection unit 100 are biased to protrude out of the housing base 111 by the bias force of the coil springs 133A, 133B (see FIG. 11). Thus, even if a situation where the hydraulic hose is damaged or so on happens in the first connected state or the second connected state, resulting in the supply of pressured oil to the for-connection-pins hydraulic cylinder 132 stopping, the connection pins 131A, 131B can maintain the state of being connected with the connection holes H1 or H2 of the first link members 81A, 81B. Therefore, the connected state of the connection unit 100 and the first link members 81A, 81B can be prevented from being unintentionally released, and thus safety is high.

The for-connection-pins hydraulic cylinder 132 to operate the connection pins 131A, 131B is driven by pilot oil supplied from the pilot pump 65 (see FIG. 12). Therefore, without imposing a load on the hydraulic pump 64 to supply pressured oil for operating various hydraulic actuators that need high oil pressure and without adversely affecting the operation of various hydraulic actuators, the connection pins 131A, 131B can be made to work.

Although an embodiment of the present invention has been described above, the scope of the present invention is not limited to the above embodiment. For example, although in the above embodiment the connection unit 100 is pivotally joined to the first link members 81A, 81B on the pivot joint axis line of the first link members 81A, 81B and the second link member 82, the invention is not limited to this. The connection unit 100 may be pivotally joined to the first link members 81A, 81B at another position, or the connection unit 100 does not have to be pivotally joined to the first link members 81A, 81B. Further, in the above embodiment the connection position that can be selected when the connection unit 100 is connected to the first link members 81A, 81B via the connection pins 131A, 131B, is one of two positions, the position of the connection hole H1 and the position of the connection hole H2, but three or more positions may be provided as the connection position that can be selected.

Although in the above embodiment the actuator to operate the connection pins 131A, 131B is a hydraulic actuator (the for-connection-pins hydraulic cylinder 132) driven by pilot oil supplied from the pilot pump 65, the invention is not limited to this. As the actuator to operate the connection pins 131A, 131B, a hydraulic actuator driven by operating oil supplied from the hydraulic pump 64 may be used, or an actuator driven by air pressure or an actuator driven by electromagnetic force may be used.

Further, although in the above embodiment the tilt bucket 70 is used as the attachment vertically swingably attached to the tip of the arm 33, the invention is not limited to this. A normal bucket, breaker, crusher, cutter, auger device, or the like can be used as the attachment. Although the above embodiment describes the case where the present invention is applied to the working device (shovel device 30) that the hydraulic shovel 1 has, the present invention can be applied likewise also to working devices which working vehicles other than hydraulic shovels have, or working devices other than working devices which working vehicles have, and the same effect can be obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This invention claims the benefit of Japanese Patent Application No. 2018-166839 which is hereby incorporated by reference.

What is claimed is:

1. A working device comprising:

an arm (33) to which an attachment (70) for work can be vertically swingably attached around a first joint axis (P3);

a first link member (81A,81B) pivotally joined at one end to the arm (33) vertically swingably around a second joint axis (P5);

a second link member (82) pivotally joined at one end to the attachment (70) vertically swingably around a third joint axis (P6), and pivotally joined at an other end to an other end of the first link member (81A,81B) vertically swingably around a fourth joint axis (P7); and an attachment hydraulic actuator (38) being extendable and retractable in an axial direction for making vertical swing of the attachment (70) with respect to the arm (33), the attachment hydraulic actuator (38) being joined at its base end to the arm (33) vertically swingably around a fifth joint axis (P4), wherein, the working device further comprises a connection unit (100), which is joined at a first connection part (113) to a tip end of the attachment hydraulic actuator (38) vertically swingably around a sixth joint axis (P8), and is joined at a second connection part (114) to a joint portion of first link member (81A,81B) and the second link member (82) vertically swingably around the fourth joint axis (P7), and also is able to be joined at a third connection part to the first link member (81A, 81B), the third connection part comprises a housing (110) having openings (111*a*) open to right and left directions, connection pins (131A,131B) provided in the housing to be able to be protruded and retracted through the openings in right and left directions, and a connection pin operating actuator provided in the housing to protrude and retract the connection pins, the first link member (81A,81B) has a plurality of connection holes (H1,H2) into which the connection pins (131A,131B) can be inserted into and pulled out, and the connection pins (131A,131B) can be inserted into the connection holes (H1,H2) selectively to connect the connection unit with the first link member (81A,81B) and can be retracted from the connection holes (H1,H2) to disconnect the connection unit from the first link member (81A,81B), the plurality of connection holes (H1,H2) are arranged on a same circumference with the fourth joint axis (P7), and the working device is configured such that, when the connection unit (100) is swung around the fourth joint axis (P7) by the attachment hydraulic actuator (38) while the connection pins (131A,131B) have been pulled out of the connection holes (H1,H2), the connection pins (131A,131B) can be faced with the connection holes (H1,H2) selectively to be able to be inserted into.

2. The working device according to claim 1, wherein on the connection unit (100) and the first link member (81A, 81B), there are provided stoppers (81*a*,171) for alignment which abut on each other for restricting further swing of the connection unit (100) with respect to the first link member (81A,81B) when the connection pin (131A,131B) faces with one of the connection holes (H1, H2) to be able to be inserted into, while the connection pin (131A,131B) has been retracted and pulled out of the connection holes (H1, H2) and the connection unit (100) is swung around the fourth pivot joint axis (P7) by the attachment hydraulic actuator (38).

3. The working device according to claim 1, wherein the connection pin (131A,131B) is swingably attached to a rod (136A,136B) tip of the connection pin operating actuator.

4. The working device according to claim 1, which comprises, in the housing, biasing members (133A,133B) to bias the connection pins in directions in which to protrude out of the openings.

5. The working device according to claim 1, wherein the connection pin operating actuator is configured to be driven by pilot oil supplied from a pilot pump.

6. The working device according to claim 1, wherein the attachment is a bucket.

7. The working device according to claim 1, which is incorporated in a working vehicle comprising a movable traveling unit and a turning body horizontally pivotally provided on a top of the traveling unit.

* * * * *